US006772693B2

(12) United States Patent
Kuru et al.

(10) Patent No.: US 6,772,693 B2
(45) Date of Patent: Aug. 10, 2004

(54) ARRANGEMENT FOR SUPPORTING MORTAR SHELL INTO BARREL OF WEAPON

(75) Inventors: Mauri Kuru, Tampere (FI); Ari Makkonen, Vammala (FI)

(73) Assignee: Patria Vammas Oy, Vammala (FI)

( * ) Notice: Subject to any disclaimer, the term of this patent is extended or adjusted under 35 U.S.C. 154(b) by 0 days.

(21) Appl. No.: 10/348,207

(22) Filed: Jan. 21, 2003

(65) Prior Publication Data

US 2004/0107857 A1 Jun. 10, 2004

(30) Foreign Application Priority Data

Jun. 27, 2002 (FI) ..... 20021263

(51) Int. Cl.[7] ..... C06D 3/00; F42B 5/18; F42C 00/00

(52) U.S. Cl. ..... 102/293

(58) Field of Search ..... 102/293, 436, 102/520; 89/1.806

(56) References Cited

U.S. PATENT DOCUMENTS 2,872,864 A * 2/1959 Barnes et al. ..... 102/436
5,503,080 A 4/1996 Goward et al. ..... 102/293
6,257,148 B1 * 7/2001 Toivonen et al. ..... 102/439
6,272,997 B1 * 8/2001 James et al. ..... 102/293

FOREIGN PATENT DOCUMENTS

GB 1452778 10/1976
WO 98/33018 7/1998

* cited by examiner

*Primary Examiner*—Charles T. Jordan
*Assistant Examiner*—Jordan Lofdahl
(74) *Attorney, Agent, or Firm*—Ladas & Parry

(57) ABSTRACT

A support member for supporting a mortar shell (1) into a barrel (2) of a weapon, and a method for attaching said supporting member (6) to a tail (4) in the mortar shell (1). The supporting member (6) includes a support element (8) provided with a rim flange (7) and a firing mechanism (15). The support element (8) is supported by means of one or more attachment pieces (10) against a front rim (23) in guiding fins (5) in the mortar shell (1). The attachment pieces (10) include a predetermined deformable point enabling the detachment of the fired mortar shell (1) from the supporting member (6).

10 Claims, 3 Drawing Sheets

ARRANGEMENT FOR SUPPORTING MORTAR SHELL INTO BARREL OF WEAPON

FIELD OF THE INVENTION

The invention relates to a support member for supporting a mortar shell into a barrel of a breech-loading weapon. The support member comprises a support element including a rim flange and a firing mechanism for firing the actual primer of the mortar shell. The support member further includes means for attaching the support element to at least one guiding fin disposed at the tail of the mortar shell. The invention also relates to a method for attaching a support member to a mortar shell.

BACKGROUND OF THE INVENTION

A mortar can be arranged on a movable base, such as an armored vehicle, allowing the mortar to be moved conveniently from one place to another and, on the other hand, allowing it to be rapidly moved from the emplacement into safety. When the intention is to use a mortar for firing vertically or downward, the problem is that the mortar shell does not stay in place in the smoothbore barrel of the mortar, but may slide forward in the barrel, so that it can no longer be fired. U.S. Pat. No. 5,503,080 discloses a support member attachable by means of friction to tail fins in the mortar shell. However, the friction joint taught by the publication does not achieve sufficiently reliable attachment of the support member. Furthermore, the dimensions of the support member and the tail fins show at least some deviations due to the manufacture, which cause variation in the magnitude of the attachment force.

BRIEF DESCRIPTION OF THE INVENTION

The object of the present invention is to provide a new and improved support member for supporting a mortar shell into the barrel of a breech-loading weapon, and a method for attaching such a support member.

The support member of the invention is characterized in that the means for attaching the support element include at least one attachment piece; the attachment piece including at least one longitudinal shaft, the shaft being adaptable substantially longitudinally to the mortar shell, and a first end of the shaft being supportable to the support element; and a second end of the shaft of the attachment piece including a support portion transversal to the longitudinal axis of the mortar shell for supporting the attachment piece to the front surface of the guiding fin; and the attachment piece including at least one predetermined deformable point allowing a fired mortar shell to be detached from the support member.

The method of the invention is characterized by supporting the support member to the front surface of at least one guiding fin by means of at least one attachment piece arranged between the support element and said front surface.

The essential idea of the invention is to attach a support member, including a rim flange and a firing member, to the tail of the mortar shell. The front rims of the guiding fins at the tail of the mortar shell are utilized in attaching the support member. For the attachment, the support member is provided with at least one attachment piece including at least one shaft portion, longitudinal to the mortar shell, and a transverse support portion. Said support portion is arranged to settle against the front rim of the guiding fin. The attachment piece further includes at least one predetermined point arranged to deform during firing and thus to enable the detachment of the mortar shell from the support member.

In the invention, attaching the support member to the tail of the mortar shell is based on shape locking, the attachment being more reliable than attachment based on friction. Furthermore, possible dimensional variance due to the manufacture of the mortar shell does not affect the magnitude of the attachment forces and the fastening of the support member as critically as in a friction-locked solution. In the inventive solution, attachment forces are relatively easy to manage. A further advantage of the invention is that the support member is easily and rapidly attachable to the tail of the mortar shell even under difficult circumstances.

The essential idea of an embodiment of the invention is that the attachment piece is provided with a weakened point, which is arranged to break or bend when the mortar shell is fired. The weakening can be provided by arranging a portion having a smaller cross-section at the predetermined point. The weakening ensures that the attachment piece breaks or bends at the preplanned point, and that the deformation takes placed in a controlled manner and not until a higher force than the preplanned attachment force is directed to the attachment piece. This ensures that the attachment piece or its parts do not under any circumstances follow the fired mortar shell, and do consequently not damage the weapon or affect the aerodynamics of the mortar shell.

The essential idea of an embodiment of the invention is to arrange the attachment piece to form a loop around at least one guiding fin.

The essential idea of an embodiment of the invention is that the shaft and the support portion form a substantially T-shaped portion at the front end of the attachment piece. This allows the shaft to be arranged between two adjacent guiding fins, the transverse support portion being, in turn, supportable against the front rims of adjacent guiding fins.

The essential idea of an embodiment of the invention is that the support member includes a support ring to which the rear end of the attachment piece is supported, and the support ring can be pulled backward by means of the support element. In this case, the attachment piece can be tightened to the desired tightness between the guiding fin and the support ring.

BRIEF DESCRIPTION OF THE FIGURES

The invention will be described in detail in the accompanying drawings, in which FIG. 1 schematically shows a mortar shell supported by means of the support member of the invention into the barrel of a weapon.

For the sake of clarity, the figures show the invention in a simplified manner. In the figures, like parts are denoted by like reference numbers.

DETAILED DESCRIPTION OF THE INVENTION

Figure 1:
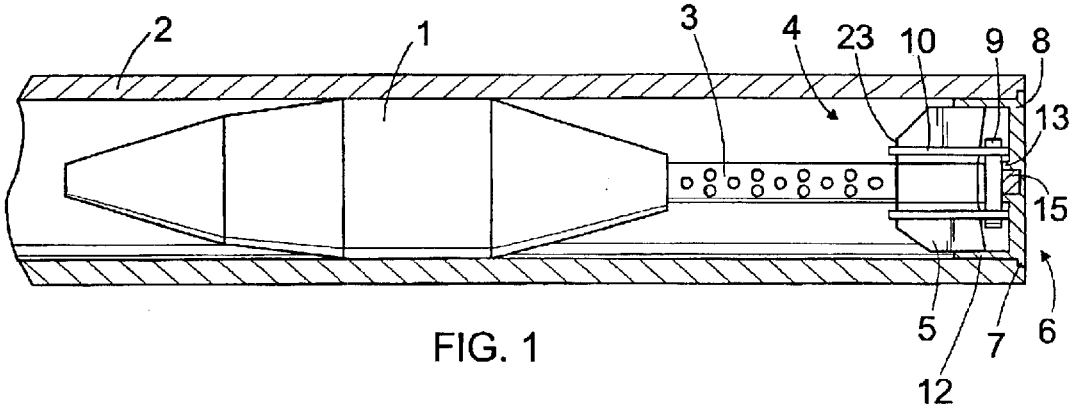

In FIG. 1, a mortar shell 1 is arranged in a barrel 2 of a breech-loading weapon. The weapon can be a mortar, the inner surface of the barrel 2 being substantially smooth. The rear part of the mortar shell 1 is provided with a tail tube 3 and a tail 4. The tail 4 comprises one or typically several guiding fins 5 for affecting the trajectory of the mortar shell 1. The details of the construction of the mortar shell 1 may deviate from the structure shown in the figure. For the sake of clarity, the breech of the weapon and other details are not shown. At the tail 4 is attached a support member 6 of the invention for keeping the mortar shell 1 in place in the barrel 2 until it is fired. A rim flange 7 in the support member 6 prevents the mortar shell 1 from moving forward in the barrel 2 when the barrel 2 is aimed horizontally or even if the barrel 2 pointed downward. The support member 6 is dimensioned to tolerate not only the load caused by the mass of the mortar shell 1 but also any forces caused by vibration and acceleration.

Figure 2:
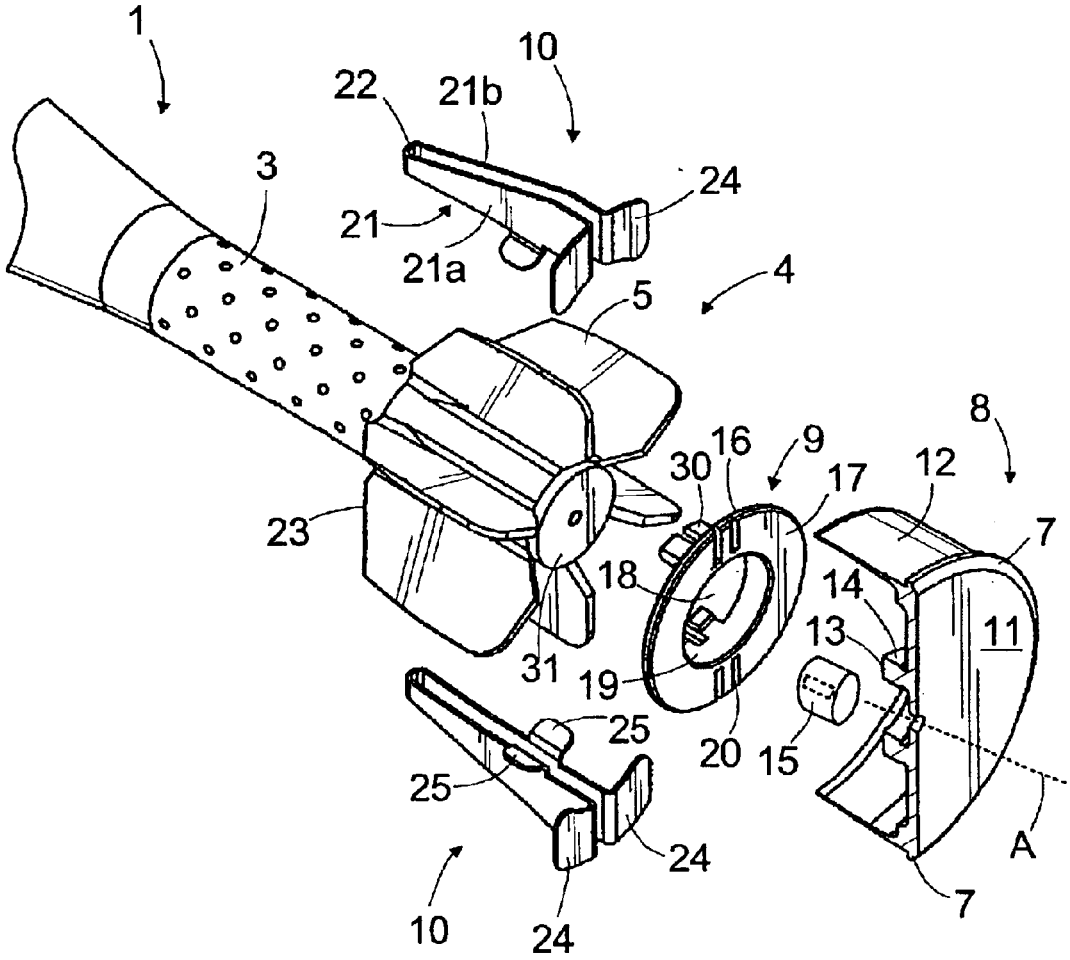
FIG. 2 is a perspective schematic view of an arrangement of the invention with the parts drawn apart, FIG. 3 schematically shows the arrangement of FIG. 2 assembled and attached to a mortar shell, FIG. 4 schematically shows the principle of a second attachment piece of the invention, and FIG. 5 schematically shows the principle of a third attachment piece of the invention.
Figure 3:
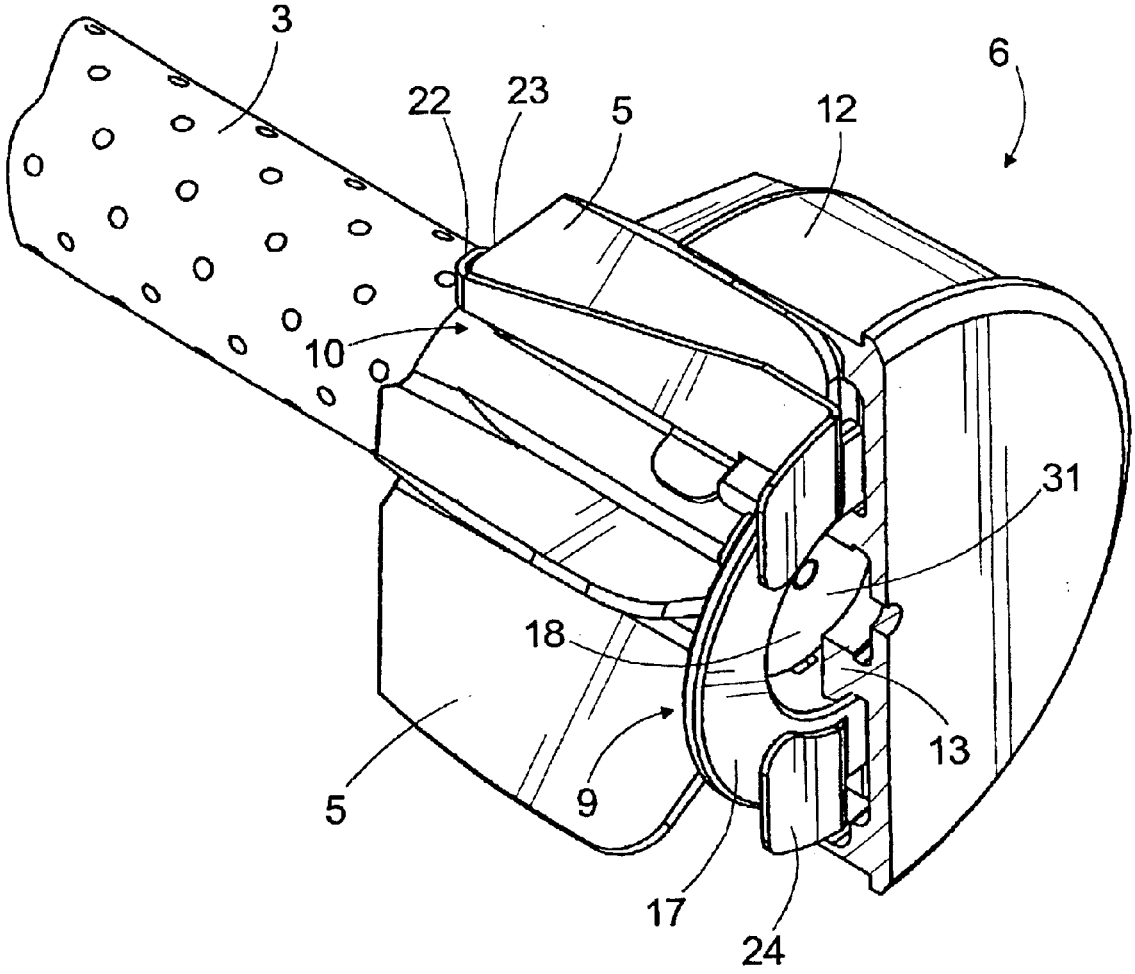

The structure of the support member 6 according to the invention is described next with reference to FIGS. 2 and 3. In FIG. 2, the parts of the support member 6 are shown pulled apart, and FIG. 3 shows the structure assembled and installed in the mortar shell 1. The support member 6 shown in FIGS. 2 and 3 comprises a support element 8, a support ring 9, and two attachment pieces 10. It is apparent that the number of attachment pieces can be selected according to the required attachment force and the number of guiding fins 5.

The support element 8 comprises an end 11, an outer mantle 12 and a rim flange 7. The support element 8 is provided with a sleeve 13 on the longitudinal axis A. The outer circumference of the sleeve is provided with threads 14. Inside the sleeve is arranged a firing mechanism 15, which may comprise an intermediate firing pin. The firing pin of the weapon may be arranged to strike the primer of the mortar shell 1 via said intermediate firing pin and fire the propelling charge of the mortar shell 1. Other firing mechanisms known per se in the art can naturally be applied. For the firing mechanism 15, the inner diameter of the sleeve 13 may be provided with threads, allowing the firing mechanism 15 to be detachably driven into the sleeve 13. The outer mantle 12 in the support element 8 may be dimensioned to allow at least part of the tail 4 of the mortar shell 1 to be settled inside it. On the other hand, in some cases the outer mantle 12 is hardly required at all. Furthermore, the barrel 2 of the weapon may be provided with a groove, wherein the rim flange 7 included in the support element 8 can settle once the mortar shell 1, provided with the support member 6, is loaded into the barrel 2.

The support ring 9 comprises a front surface 16, a rear surface 17, and a middle hole 18. The middle hole 18 is provided with internal treads 19, which correspond to the external threads 14 in the sleeve 13 of the support element 8. The support ring 9 can be positioned relative to the guiding fins 5 by means of projections 30 provided with slots. Furthermore, the outer circumference of the support ring 9 may include notches 20 or other positioning elements for positioning the attachment pieces 10. In addition, the notches 20 may serve to hold the attachment pieces 10 in place and thus facilitate the assembly of the support member 6.

The attachment pieces 10 shown in FIGS. 2 and 3 comprise a longitudinal shaft 21 comprising a first shaft portion 21*a* and a second shaft portion 21*b*. The front ends of the shaft portions 21*a* and 21*b* are connected to one another by means of a support portion 22. In this case, the front end of the attachment piece 10 is loop-shaped, and can be arranged around the guiding fin 5 in the manner shown in FIG. 3. The support portion 22 is thus arranged to settle against a front rim 23 in the guiding fin 5. The rear end of the shaft portions 21*a* and 21*b* is provided with one or more transverse portions 24, supported against the rear surface 17 of the support ring 9 after the attachment piece 10 is arranged in place and the shaft portions 21*a* and 21*b* are placed in the notches 20. As FIG. 2 and 3 show, the cross section of the support portion 22 of the attachment piece 10 is arranged smaller than that of the shaft portions 21*a* and 21*b*. Furthermore, the transverse portions 24 are arranged rigid. This ensures that the weakest point of the attachment piece 10 is in the support portion 22. Once the mortar shell 1 is fired, the front rim 23 of the guiding fin 5 breaks the support portion 22, and substantially no material belonging to the support member 6 is discharged with the mortar shell 1, potentially causing damage to the barrel 2 of the weapon or affecting the trajectory of the mortar shell 1. The attachment piece 10 may further comprise flaps that support the attachment piece 10 against the tail 4 of the mortar shell. The attachment piece 10 can be manufactured from a metal plate by cutting and bending. Alternatively, it can be cast of metal. Furthermore, the attachment piece 10 may be made from a plastic material for instance by injection molding, or it may be a composite structure. The attachment piece 10 is dimensioned to endure the required attachment forces, but, on the other hand, breaks by action of a predetermined force thus allowing the mortar shell 1 to be detached from the support member 6 once the firing has taken place.

FIG. 3 shows the support member 6 assembled and attached to the tail 4. For the sake of clarity, the firing mechanism 15 is not shown in FIG. 3. The support member 6 is installed as follows. The support ring 9 is first arranged in place, its first surface 16 being against the read end 31 of the tail tube 3, and the rear parts of the guiding fins 5 extending into the slots of the projections 30 in the support ring 9. Said slots may be dimensioned to keep the support ring 9 in place by the action of friction during the assembly. The attachment pieces 10 are then arranged in place. Each attachment piece forms a loop around an adjacent guiding fin 5. The transverse portions 24 in the rear part of the attachment piece 10 settle on the side of the rear surface 17 of the support ring 9 when the attachment piece 10 is pushed into the notches 20 in the support ring 9. The notches 20 can be dimensioned to keep the attachment piece 10 in place by the action of friction during the assembly. The firing mechanism 15 is then installed in the support element 8, and the support element 8 is arranged in the rear part of the tail 4, the sleeve 13 settling at the middle hole 18 of the support ring 9. The support element 8 is then driven around its longitudinal axis A, whereby the threads 14 of the sleeve 13 are wound into the threads 19 in the middle hole 18. As the winding is continued, the front rim of the sleeve 13 is pressed against the rear end 31 of the tail tube 3 starting to pull the support ring 9 backward thus tightening the attachment pieces 10. This allows the attachment of the support member 6 to be adjusted without clearance in the axial direction of the mortar shell 1. The adjustment enables the compensation of any dimensional or shape deviations of the mortar shell 1 and the support member 6.

There are typically at least two attachment pieces 10 and they are arranged substantially symmetrically relative to the longitudinal axis A, whereby the attachment forces are evenly distributed. When needed, the attachment piece 10 may, however, be formed as one uniform piece comprising two or more substantially symmetrically formed shaft portions 21 and support portions 22.

The support ring 9, the support element 8 and the firing mechanism 15 can typically be used several times to fire mortar shells 1. Only the attachment pieces 10 may damage during firing, wherefore they are replaced for each mortar shell 1.

Figure 4:
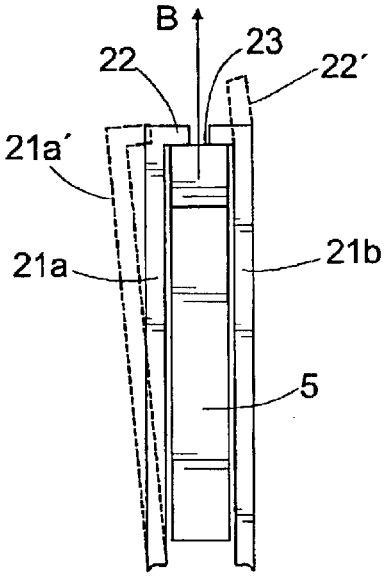

FIG. 4 is a top view of a second solution for attaching the support member 6 to the guiding fin 5 of the mortar shell 1. In this embodiment, the shaft potions 21*a* and 21*b* of the attachment piece 10 are not connected to one another at their front ends, but each shaft portion 21*a* and 21*b* comprises a special transverse support portion 22. Also in this case, the guiding fin 5 is surrounded by a kind of loop, although the loop is not closed. Once the mortar shell 1 is discharged upon firing in direction B, the shaft portions 21*a* and 21*b* may bend to the side, as the figure shows by a broken line 21*a*'. In this case, the shaft portion 21 may be dimensioned to bend by the action of a force of a predetermined magnitude. Alternatively, the support portion 22 may bend relative to the shaft portion 21, as FIG. 4 shows by a broken line 22'. For the sake of clarity, FIGS. 4 and 5 do not show the rest of the structures of the mortar shell 1 and the support member 6.

Figure 5:
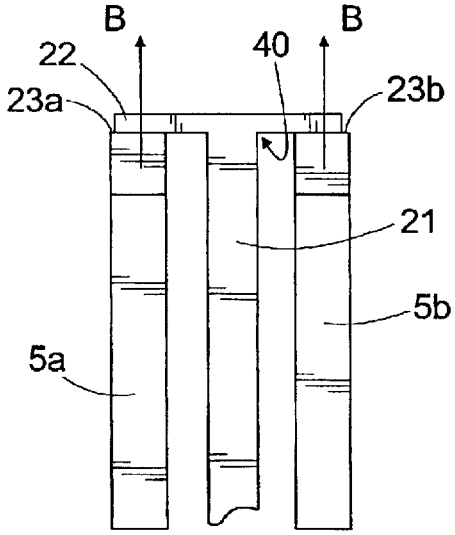

FIG. 5 is a top view of another solution for attaching the support member 6 to the guiding fin 5 of the mortar shell 1. In this solution, the front end of the attachment piece 10 is substantially T-shaped comprising a shaft 21 and a transverse support portion 22. Such an attachment piece 10 can be arranged between two adjacent guiding fins 5*a* and 5*b*, the support portion 22 settling against the front rims 23*a* and 23*b* of each guiding fin 5*a* and 5*b*. In this solution, the deformable point is arranged in the support portion 22. The support portion 22 is measured to bend or break when the mortar shell 1 is fired. The support portion 22 may be designed to break for instance at point 40 shown in FIG. 5. The shaft 21, in turn, and its attachment to the support element 8 are dimensioned so that the shaft 21 cannot in any case be discharged along with the mortar shell 1.

The drawing and the related description are only intended to illustrate the inventive idea. The details of the invention may vary within the scope of the claims. Accordingly, the attachment piece may be connected to the support element in another manner than by the support ring as shown in the figures. Furthermore, the rear end of the attachment pieces can be connected by means of screws or the like to the support ring or the like member.

What is claimed is:

1. A support member for supporting a mortar shell into a barrel of a breech-loading weapon, the support member comprising a support element including a rim flange and a firing mechanism for firing the actual primer of the mortar shell, at least one attachment piece for attaching the support element to at least one guiding fin disposed at the tail of the mortar shell, the attachment piece including at least one longitudinal shaft, the shaft being adaptable substantially longitudinally relative to the mortar shell, and a first end of the shaft being supportable to the support element;

and a second end of the shaft of the attachment piece including a support portion transversal to the longitudinal axis of the mortar shell for supporting the attachment piece to the front surface of the guiding fin;

and the attachment piece including at least one predetermined deformable point allowing a fired mortar shell to be detached from the support member.

2. The support member of claim 1, whose attachment piece includes a predetermined weakened point, at which the attachment piece is arranged to break by the action of forces caused by firing the mortar shell.

3. The support member of claim 1, wherein the deformable point is arranged in the support portion, and wherein the area of the cross-section at the deformable point is smaller than in other portions of the attachment piece.

4. The support member of claim 1, wherein the support portion or shaft of the attachment piece is arranged to bend relative to each other and to release the attachment between the attachment piece and the guiding fin by the action of forces caused by firing the mortar shell.

5. The support member of claim 1, wherein the shaft of the attachment piece includes a longitudinal first shaft portion and a second shaft portion, and the second ends of the shaft portions are combined to one another by a transverse support portion, the attachment piece forming a loop that is adaptable around at least one guiding fin.

6. The support member of claim 1, wherein the shaft and support portion of the attachment piece are arranged at one end of the attachment piece substantially T-shaped, whereby the shaft is adaptable between two adjacent guiding fins and the support portion is adaptable against the front surfaces of said adjacent guiding fins.

7. The support member of claim 1, wherein the support member includes a support ring for supporting at least one attachment piece to the sup port element, the support ring includes a front surface, a rear surface and a middle hole provided with first threads, the front surface of the support ring is adaptable on the side of the rear surface of the tail of the mortar shell, the first end of the attachment piece is provided with at least one transverse portion that is supportable against the rear surface of the support ring, the longitudinal axis of the support element is provided with a sleeve having a front surface and an outer circumference provided with second threads, and the sleeve of the support element is drivable into the middle hole of the support ring, whereby the front surface of the sleeve is arranged to settle against the rear surface of the tail of the mortar shell and pull the support ring and the attachment piece backward for tightening the support member at the tail of the mortar shell.

8. The support member of claim 7, wherein the support ring includes first positioning members for positioning the support ring at a predetermined position relative to the guiding fins of the tail of the mortar shell, and the outer circumference of the support ring includes second positioning members for positioning each attachment piece at a predetermined position relative to the support ring.

9. A method for attaching a support member to a mortar shell, the method comprising:

attaching the support member to the tail of the mortar shell, the support member including a support element provided with a rim flange and a firing mechanism;

supporting the support member to the front surface of at least one guiding fin at the tail of the mortar shell by means of at least one attachment piece arranged between the support element and said front surface.

10. The method of claim 9, comprising adapting a substantially loop-shaped attachment piece around at least one guiding fin.

* * * * *